US006481445B1

(12) United States Patent
Miraglia

(10) Patent No.: US 6,481,445 B1
(45) Date of Patent: Nov. 19, 2002

(54) MACRO FILAMENT MASCARA BRUSH

(75) Inventor: Loretta A. Miraglia, Monsey, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/501,038

(22) Filed: Feb. 9, 2000

(51) Int. Cl.[7] ..... A45D 40/26; A45D 44/18; A45D 40/24

(52) U.S. Cl. ..... 132/218; 132/320; 132/313; 132/317

(58) Field of Search ..... 132/218, 320, 132/317, 313, 216; 401/122, 126, 129, 128

(56) References Cited

U.S. PATENT DOCUMENTS

| | | | | | |
|---|---|---|---|---|---|
| 3,706,111 | A | * | 12/1972 | Curtin et al. | 132/218 |
| 4,278,415 | A | | 7/1981 | Pfeiffer | 425/466 |
| 4,365,642 | A | | 12/1982 | Costa | 132/88.5 |
| 4,733,425 | A | | 3/1988 | Hartel et al. | 15/206 |
| 4,861,179 | A | | 8/1989 | Schrepf et al. | 401/129 |
| 4,887,622 | A | | 12/1989 | Gueret | 132/320 |
| 4,927,281 | A | | 5/1990 | Gueret | 401/129 |
| 5,238,011 | A | | 8/1993 | Gueret | 132/218 |
| 5,345,644 | A | | 9/1994 | Gueret | 15/160 |
| 5,370,141 | A | | 12/1994 | Gueret | 132/218 |
| 5,427,595 | A | | 6/1995 | Pihl et al. | 51/298 |
| 5,482,059 | A | | 1/1996 | Miraglia | 132/218 |
| 5,657,778 | A | * | 8/1997 | Gueret | 132/320 |
| 5,709,230 | A | * | 1/1998 | Miraglia | 132/218 |
| 5,778,476 | A | | 7/1998 | Squillaci et al. | 15/167.1 |
| 5,836,769 | A | * | 11/1998 | Spencer | 433/216 |
| 6,016,815 | A | * | 1/2000 | Christoforou et al. | 132/218 |
| 6,073,634 | A | * | 6/2000 | Gueret | 132/218 |
| 6,151,745 | A | * | 11/2000 | Roberts et al. | 15/167.1 |

FOREIGN PATENT DOCUMENTS

| | | | |
|---|---|---|---|
| CA | 1 158 602 | 12/1983 | |
| DE | 298 08 475 U1 | 9/1998 | A46B/15/00 |

* cited by examiner

*Primary Examiner*—John J. Wilson
*Assistant Examiner*—Robyn Kieu Doan
(74) *Attorney, Agent, or Firm*—Kenyon & Kenyon

(57) ABSTRACT

A mascara brush has bristles that are wider and stiffer than conventional "soft" bristles. The brush has a central core formed from a pair of twisted wire segments. A plurality of radially extending bristles is secured between the pair of twisted wire segments to form a brush portion at an end of the core. The bristles are secured in a quantity of from 4 to 27 bristles per turn of the twisted wire segments. Each of the bristles has a diameter of from 8 mil to 18 mil and is made from a thermoplastic elastomer material having a durometer of between 62D and 82D. Preferably, the bristles have a diameter of 10 mil to 13 mil, are made from an elastomeric polyester material having a durometer of about 72D and are secured in a quantity of from 7–14 bristles per turn. The material from which the bristles are made is softer than the material from which conventional bristles are made to ensure that the bristles will be supple enough to facilitate application and avoid irritation to the user.

10 Claims, 1 Drawing Sheet

Fig. 1
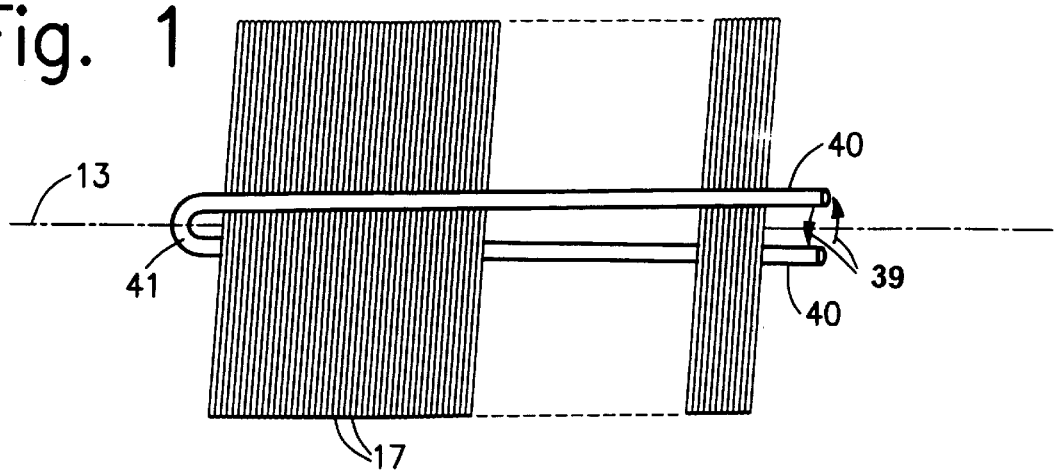
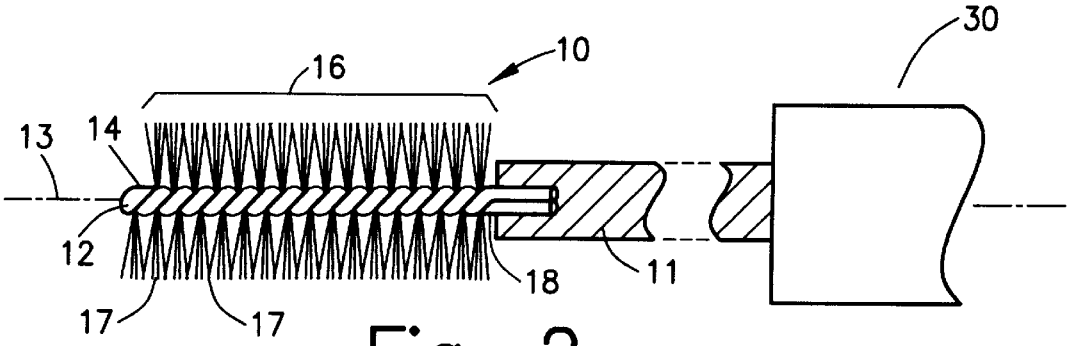
Fig. 2
Fig. 3
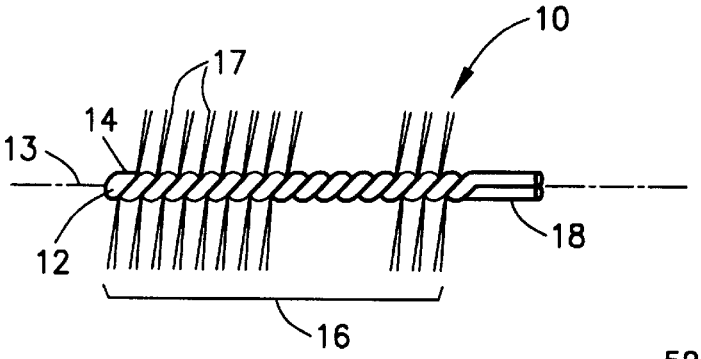
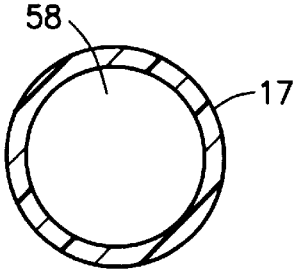
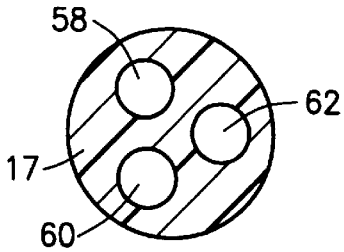
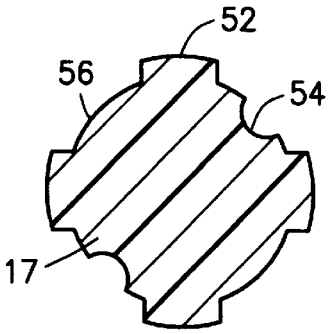
Fig. 5 Fig. 6 Fig. 4

MACRO FILAMENT MASCARA BRUSH

BACKGROUND OF THE INVENTION

1. Field of the Invention

The present invention relates to a brush for applying cosmetic products to hair. In particular the present invention relates to a brush for the application of mascara to eyelashes.

2. Description of the Prior Art

Brushes having a twisted wire core are known, such as, for example, mascara brushes used to apply mascara to a user's eyelashes. A typical mascara brush is comprised of a core formed from a single metallic wire folded in a generally u-shaped configuration to provide a pair of parallel wire segments. Bristles (also referred to as filaments or fibers), usually comprised of strands of nylon, are disposed between a portion of a length of the wire segments. The wire segments are then twisted, or rotated, about each other to form a helical core (also known as a twisted wire core) which holds the filaments substantially at their midpoints so as to clamp them. In this way, a bristle portion or bristle head is formed with radially extending bristles secured in the twisted wire core in a helical or spiral manner. See, for example, U.S. Pat. No. 4,887,622 to Gueret, and U.S. Pat. No. 4,733,425 to Hartel et al.

The conventional purpose of a mascara brush is to apply mascara to a user's eyelashes. To this end, brushes must be capable of picking up and transporting a supply of mascara from a reservoir and depositing it on a user's eyelashes. See, for example, U.S. Pat. No. 4,365,642 to Costa, U.S. Pat. No. 4,733,425 to Hartel et al., and U.S. Pat. No. 4,887,622 to Gueret. Because of their greater flexibility and ability to bend around lashes to deposit mascara, softer, more supple bristles are thought to be better suited for applying mascara. Softer, more supple bristles are also thought to be less irritating to the user should contact occur. Bristles for a conventional twisted wire core mascara brush are generally made with a nylon material, e.g., polyamide, having a hardness or durometer substantially greater than 85D (e.g., approximately 115R on the Rockwell scale). To make the bristles of a conventional brush more supple, the diameter of the bristles is reduced to, for example, 2.4 mil (6 hundredths of a millimeter). However, the smaller surface area of smaller diameter bristles is thought to transfer less mascara than a larger diameter bristles. To compensate for the smaller surface area on each bristle, conventional brushes with smaller diameter bristles tend to have higher bristle density to increase the loading capacity. This yields a brush with a bristle envelope, also referred to herein as a brush surface (i.e., the relative envelope or surface defined by the bristle tips) that is "closed", i.e., that has few or narrow clearances or spaces between bristle tips.

Mascara, which is typically highly viscous, tends to clump when applied to eyelashes. The clumps of mascara are typically combed out as a finishing step to the application process. Stiffer bristles are thought to be better suited for combing out clumps and properly separating lashes. However, the combing and separating functions are thought to be better accomplished with brushes a having relatively open bristle envelope or brush surface, i.e., an envelope or surface that has numerous or wide clearances or spaces between bristles to make the brushes more 'comb-like'.

Thus, a brush with softer, more numerous bristles was thought to be well suited for applying mascara but less well suited for combing out clumps and separating lashes. Conversely, a brush with stiffer, fewer bristles was thought to be well suited for combing and separating lashes but less well suited for applying mascara to lashes. While a separate brush can be used for each function, i.e., a soft brush for application and a stiff brush for combing, a single brush that can both apply mascara and comb out clumps would be preferred for the convenience of the user.

An example of a brush that is said to provide good application and combing characteristics is shown in U.S. Pat. No. 4,861,179 to Schrepf et al., which discloses a brush having a combination of conventional soft bristles and conventional stiff bristles. Another example of a brush said to provide good application and combing characteristics is shown in U.S. Pat. No. 5,238,011 to Gueret. The Gueret patent discloses bristles made of a soft material having a shore hardness of 20A to 40D (as noted above, a conventional bristle typically has a durometer of over 85D), and a large diameter in a range of 3.9 to 13.8 mil (10 to 35 hundredths of a millimeter), which is at least 1.5 mil (~4 hundredths of a millimeter) wider than a typical soft polyamide bristle). As disclosed by Gueret, the diameter is said to be sufficiently large to prevent too high a degree of suppleness. The resulting brush is said to have the same degree of suppleness or softness as a conventional softer brush. Accordingly, the bristles are equivalent in stiffness to conventional bristles.

While the forgoing brushes may be suitable for the application and combing of conventional mascara, currently preferred mascaras have significantly higher viscosity (two million CPS and above). Higher viscosity mascaras tend to collapse of bristles of conventional stiffness, thus rendering a brush having bristles of conventional stiffness ineffective for purposes of application or combing. Accordingly, the forgoing brushes would not be suitable for use with such higher viscosity mascaras.

Thus, there is a need for a brush that can transfer mascara (or another cosmetic) in sufficient quantity from a reservoir to an application point, apply the mascara uniformly and in desired amounts, and comb out any undesired excess while separating eyelashes.

SUMMARY OF THE INVENTION

A mascara brush is disclosed and claimed which has bristles that are both wider and stiffer than conventional "soft" bristles. To ensure that the brush is sufficiently supple to facilitate application of mascara and avoid irritating the user, the bristles are made from a material that is significantly softer than the material from which conventional bristles are made. The brush has a central core formed from a pair of twisted wire segments. A plurality of radially extending bristles is secured between the pair of twisted wire segments to form a brush portion at an end of the core. The bristles are secured in a quantity of from 4 to 27 bristles per turn of the twisted wire segments. Each of the bristles has a diameter of from 8 mil to 18 mil and is made from a thermoplastic elastomer material having a durometer of between 62D and 82D. Preferably, the bristles are made from an elastomeric polyester material having a durometer of about 72D, a diameter of 10 mil to 13 mil and are secured in a quantity of from 7–14 bristles per turn.

The wider, stiffer bristles made of a soft material surprisingly apply mascara uniformly and in desired amounts, and comb out excess while separating lashes. It is believed that the surprising and improved capabilities are due in part to the combined increase in stiffness and width of each bristle, which yields a more stable overall brush form and a wider individual bristle surface capable of better manipulating lashes to facilitate application and combing. In particular, the wider, stiffer bristles lift lashes better to facilitate application of mascara and to facilitate set the lashes such that they have a more pronounced curl. Additionally, the softer material of the bristles facilitates application of mascara.

BRIEF DESCRIPTION OF THE DRAWINGS

FIG. 1 is a perspective view of a step in the process of making a brush of the type embodying the invention;

FIG. 2 is a side view in partial cross-section of a mascara brush in accordance with the present invention showing the bristle portion in representative form;

FIG. 3 is a side view in partial cross-section of another embodiment of the mascara brush in accordance with the present invention showing the bristle portion in representative form; and FIG. 4 is a sectional view of a bristle according to the present invention; and FIGS. 5–6 are sectional views of alternative bristles according to the present invention.

DETAILED DESCRIPTION OF THE INVENTION

Referring now to FIG. 2, a mascara applicator brush, designated generally by reference numeral 10, is shown. The brush is intended for use in a conventional mascara container (not shown) of the type having a peripheral wall defining a product storage chamber with an opening to the chamber dimensioned to receive the brush 10. The brush 10 is comprised of a central core 12 having a first or proximal end 18 connected to a shaft 11, and a second or distal end 14 opposite the proximal end 18. A longitudinal axis 13 is defined along the core 12 through the proximal and distal ends, 18 and 14, respectively. In FIG. 2, the proximal end 18 of the core 12 is shown connected to a handle 30 by way of the shaft 11, however, the proximal end 18 of the core 12 could alternatively be attached to another structure, e.g., a cap (not shown) for the container. A bristle portion 16 extends along at least part of the length of the core 12 from the distal end 14 toward the proximal end 18. The bristle portion 16 is comprised of radially extending bristles 17 attached to the core 12. The core 12 is a twisted wire core typically made by first forming a pair of parallel wire segments 40 (FIG. 1) connected at one end 41 to form a "U". The wire is of a type that is well known in the art, e.g., a conventional soft steel or iron wire, the dimensions and specifications of which are also well known. A plurality of bristles 17 of a selected length and material are placed between the pair of wire segments 40. The wire segments 40 are then twisted about the longitudinal axis 13 (see arrows 39 in FIG. 1) to secure in clamping engagement each of the bristles 17 at approximately a midpoint of the bristle. In this way, opposite ends of each bristle 17 extend radially from the twisted wire core 12. After the bristles 17 are secured, the brush head may be trimmed by any suitable means, e.g., grinding, laser cutting, etc., to have any desired shape, e.g., cylindrical, tapered, conic, bi-conic, etc.

The bristles 17 may be made by any known techniques and from a variety of materials. For example, the bristles may be made from nylon or polyamide derivatives, or from thermoplastic elastomers. The individual bristles may be extruded or manufactured by other know techniques. The individual bristles may be manufactured to a desired length, or may be cut to a desired length from a continuous filament. The individual bristles or continuous filament may be selected from any one of a number of commercially available products that are made from a relatively soft thermoplastic elastomer material having a durometer of between 62D and 82D. The preferred material is an elastomeric polyester material having a durometer of about 72D. An example of a suitable filament for making the bristles is a "Supersoft" filament (tradename, available from Du Pont Filaments, Washington, W.Va.) made from a specific polyester elastomer base material, i.e., Hytrel (a registered trademark of and available from Du Pont Corporation) 7246. Hytrel 7246 is said to have a hardness of 72D. It will be understood that, due to the relatively small diameter of such filaments, the hardness of an individual filament cannot be measured with standard test methods. However, it will also be understood that material orientation that takes place during manufacture of the filament by extrusion or other means generally causes the hardness of the filament to be greater than that of the base material. Accordingly, the hardness of individual filaments made from Hytrel 7246 will generally be greater than 72D.

The diameter of each of the bristles 17 should be large enough to provide a degree of rigidity sufficient to yield a brush that is less supple than a conventional "soft" brush, i.e., less supple than a brush having bristles with a diameter of 2.4 mil made from a material with a durometer greater than 85D. Accordingly, for bristles made from a material having a durometer of 62D to 82D, each of the bristles should have a diameter of from 8 mil to 18 mil. Preferably the diameter of the bristles will be 10 mil to 13 mil.

The bristles 17 (or the fiber from which they are made) will generally be substantially round in cross-section. However, bristles having other cross-sectional shapes are contemplated. For example, all or some bristles 17 may have an oval, triangular or triangle-like, or other cross-sectional shape. Also, the greater width of the individual bristles will more readily support cross-sectional shapes that are not round due to bristle surface features, such as, for example, one or more of the features shown in FIG. 4, i.e., grooves 54, clearances 56 or ridges 52 in the bristle surface. The grooves 54, clearances 56 or ridges 52 may run continuously, or at spaced intervals, along the length of the fiber, and may be arranged either substantially parallel to the longitudinal axis of the fiber or spirally about the longitudinal axis of the fiber. These types of structural details increase the surface area of the bristle, and correspondingly increase the mascara carrying and delivery capacity of the bristles. The wider bristles may also be mechanically enhanced to carry more cosmetic by, for example, abrading the bristle tip to increase surface texture or area. This can be accomplished by known methods with minimum effect on the strength of the bristle. The mechanically abraded bristle tips will retain more mascara at the brush surface where it can readily and more efficiently be delivered to the lashes.

The cross-section of each bristle 17 may be solid or hollow. Hollow cross-section bristles may have a single lumen or chamber 58 (see FIG. 5) or multiple, radially adjacent lumens or chambers 58, 60, 62 (see FIG. 6). Each lumen or chamber may extend through the cross-section continuously along the length of each fiber, or may be provided in the cross-section at spaced intervals along the length of each fiber. A lumen or chamber 58, 60, 62 may open outwardly at the bristle tip, whereby through capillary action it will retain an additional quantity of mascara.

The bristles 17 are provided in the bristle portion 16 of the brush such that the finished brush will have 4 to 27 bristles per turn. As is well known in the art, the phrase "bristles per turn" refers to the number of individual bristles secured in each complete twist or turn of the pair of wire segments. Preferably, the brush will have from 7 to 14 bristle per turn. Surprisingly, it has been observed that when bristles according to the invention (i.e., made from a thermoplastic elastomer material having a durometer of 62D to 82D and having a diameter of from 8 to 18 mil) are provided in bristle counts of 4–9 bristles per turn, die bristles tend to splay about more evenly in the bristle envelope (see FIG. 2). In bristle counts of 10–27 bristles per turn, the bristles according to the invention tend to be arranged in a more spiral-like row about the core 12 (see FIG. 3). In either case, the wider more rigid bristles tend to maintain the original arrangement of the bristles regardless of the bristle count even when used in higher viscosity mascaras.

In combination, the larger diameter and the soft material of the bristle yields a brush that is sufficiently soft for application purposes, and suitably stiff for lifting and combing lashes. The wider, stiffer bristles comb through lashes more efficiently. The wider bristles present a correspondingly wider bristle tip and a shaft surface area larger than a conventional bristle. The wider tip and greater surface area carry more mascara to the lashes for application. The wider bristle is sufficiently stiff to apply and comb out any excess mascara, including higher viscosity mascaras. And the wider, stiffer bristles stabilize the shape of the bristle portion the brush, making possible brushes having very low bristle counts. Brushes having very low bristle counts are desirable because they have a relatively open brush surface, i.e., numerous and wide clearances or spaces between bristle tips to make the brush more 'comb-like'. Open brush surfaces facilitate transport of mascara to the lashes, particularly mascara having higher viscosity, because the numerous and wide clearances between bristles accommodate more mascara. The bristle specifications called for herein, i.e., 4 to 27 bristles per turn, each having a diameter of from 8 mil to 18 mil and having a durometer of between 62D and 82D, will yield a brush having a relatively open brush surface. This is the case whether the bristles are splayed about (4–9 bristles per turn) or arranged in a more spiral-like row about the core (10–27 bristles per turn).

A brush having wider, stiffer bristles made of a soft material and provided in a very low bristle count surprisingly applies mascara uniformly and in desired amounts, and combs out excess while separating lashes. These effects are believed to be more pronounced when the bristles are hollow. The increased stiffness and width of each bristle leads to improved capabilities in part because the bristles form a more stable overall brush and because each provides a wider individual bristle surface capable of better manipulating lashes to facilitate application and combing. In particular, the wider, stiffer bristles are believed to lift and move lashes better to facilitate contact of the surface of the bristle with various portions of the surface of the lash. In this way, a desired volume of cosmetic is coated uniformly on the lashes. The improved lifting also facilitates the ability of the bristle to 'set' the lashes such that they have a more pronounced curl. Although useful with any conventional mascara, the improved capabilities of brushes made with bristles according to the foregoing disclosure are particularly important when used with higher viscosity, faster setting mascara formulas. The wider, stiffer bristles made of a soft material are ideal for making a single brush capable of applying such formulas in sufficient volumes and combing Out excess without the disadvantage of bristles collapsing. Additionally, when brushes having the wider, stiffer bristles made of softer materials are used with faster setting mascaras having higher viscosity, a significant improvement is realized in lifting and curling lashes, and in setting the lashes in the desired lifted and curled position.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A brush for applying mascara to eyelashes, comprising:

a central core defining a longitudinal axis, the central core formed from a pair of twisted wire segments;

a plurality of radially extending bristles secured between the pair of twisted wire segments to form a brush portion at an end of the core, the bristles secured in a quantity of from 4 to 27 bristles per turn of the twisted wire segments, each of the bristles having a diameter of from 8 mil to 18 mil and being made from a thermoplastic elastomer material having a durometer of between 62D and 82D.

2. The brush of claim 1 wherein the bristles are made from an elastomeric polyester material having a durometer of about 72D.

3. The brush of claim 2 wherein the bristles have a diameter of about 10 mil to 13 mil.

4. The brush of claim 1 wherein the bristles are secured in a quantity of from 7–14 bristles per turn.

5. The brush of claim 1 wherein the bristles are secured in a quantity of from 8–9 bristles per turn.

6. The brush of claim 1 wherein the bristles are secured in a quantity of from 11–12 bristles per turn.

7. The brush of claim 1 wherein the surface of at least one of the plurality of bristles is provided with one of a groove, a ridge or a clearance.

8. The brush of claim 1 wherein a tip of at least one of the plurality of bristles is mechanically abraded.

9. The brush of claim 1 wherein at least one of the plurality of bristles is hollow.

10. The brush of claim 9 wherein the at least one of the plurality of bristles has two or more radially adjacent lumens.

* * * * *